US008171756B2

(12) United States Patent
Cho et al.

(10) Patent No.: US 8,171,756 B2
(45) Date of Patent: May 8, 2012

(54) STEAM GENERATOR OF DRUM WASHING MACHINE

(75) Inventors: Ki Chul Cho, Masan-si (KR); Hyon Su Ahn, Gimhae-si (KR)

(73) Assignee: LG Electronics, Inc., Seoul (KR)

( * ) Notice: Subject to any disclaimer, the term of this patent is extended or adjusted under 35 U.S.C. 154(b) by 536 days.

(21) Appl. No.: 11/660,095

(22) PCT Filed: May 21, 2006

(86) PCT No.: PCT/KR2006/001901

§ 371 (c)(1),
(2), (4) Date: Feb. 2, 2009

(87) PCT Pub. No.: WO2006/126810

PCT Pub. Date: Nov. 30, 2006

(65) Prior Publication Data

US 2009/0211314 A1 Aug. 27, 2009

(30) Foreign Application Priority Data

May 23, 2005 (KR) ..... 20-2005-0014479 U
Sep. 1, 2005 (KR) ..... 10-2005-0081230

(51) Int. Cl.
*D06F 29/00* (2006.01)
*D06F 39/00* (2006.01)

(52) U.S. Cl. ..... 68/5 C; 68/3 R; 68/5 R

(58) Field of Classification Search ..... 8/149.1, 8/149.2, 149.3; 68/3 R, 5 C, 5 R
See application file for complete search history.

(56) References Cited

U.S. PATENT DOCUMENTS

2004/0244432 A1 12/2004 Kim et al.
2005/0034487 A1 * 2/2005 Oh et al. ..... 68/5 C
2005/0034489 A1 2/2005 Oh et al.

FOREIGN PATENT DOCUMENTS

CN 1534130 10/2004
CN 1580352 2/2005
CN 1580353 2/2005
EP 1507029 A2 2/2005
EP 1507032 A1 * 2/2005
EP 1507032 A1 2/2005

OTHER PUBLICATIONS

Laiying Liu, et. The Injection Molding Technique (the 1st edition). China Machine Press, 2005. pp. 174-175.*
Stitz et al., "Injection moulding technology manufacturing machine peripheral device", 2nd edition, 2004, p. 115, ISBN 3-466-22921-3 (English translation included).
Laiying Liu, ed. The Injection Molding Technique (the 1st Edition). China Machine Press, Jan. 2005: pp. 174-175, JP2004-317091.

* cited by examiner

*Primary Examiner* — Michael Barr
*Assistant Examiner* — Benjamin Osterhout
(74) *Attorney, Agent, or Firm* — McKenna Long & Aldridge LLP

(57) ABSTRACT

A steam generator is disclosed, which can prevent deformation of a housing in an injection molding process, so as to improve efficiency on connection of the housing, the steam generator comprising the housing which defines the exterior of the steam generator, and holds washing water therein; and at least one deformation-preventing rib provided in the housing so as to prevent the housing from being deformed in an injection molding process.

14 Claims, 3 Drawing Sheets

[Fig. 1]
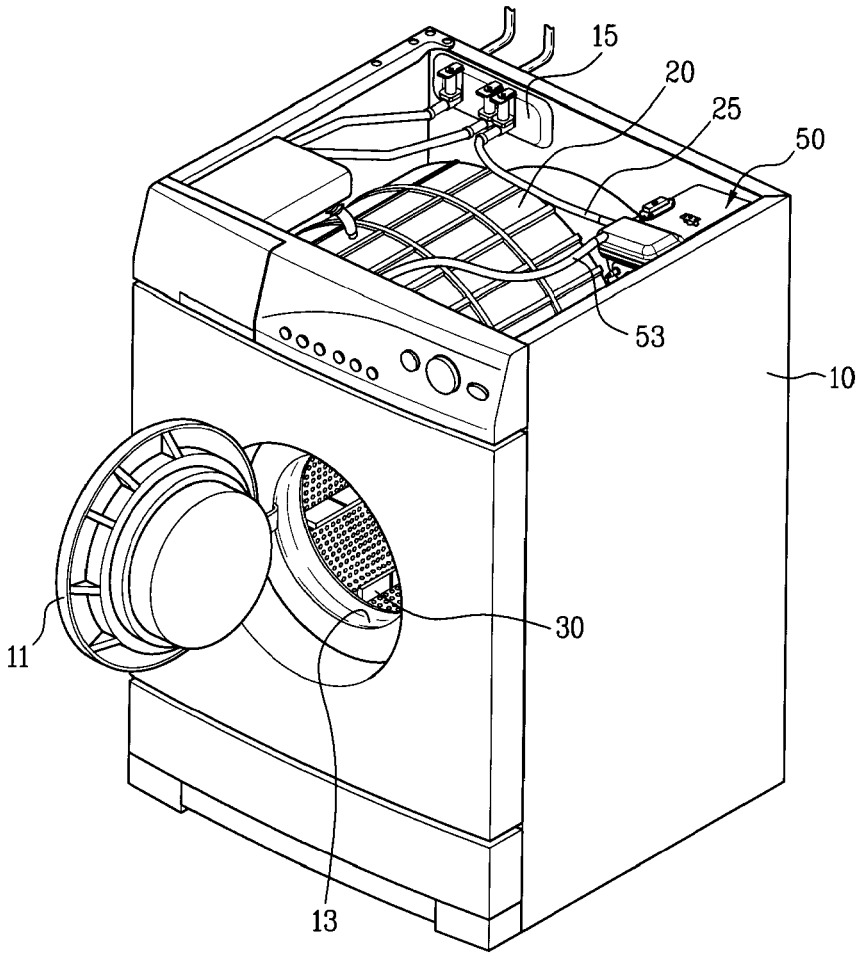
[Fig. 2]
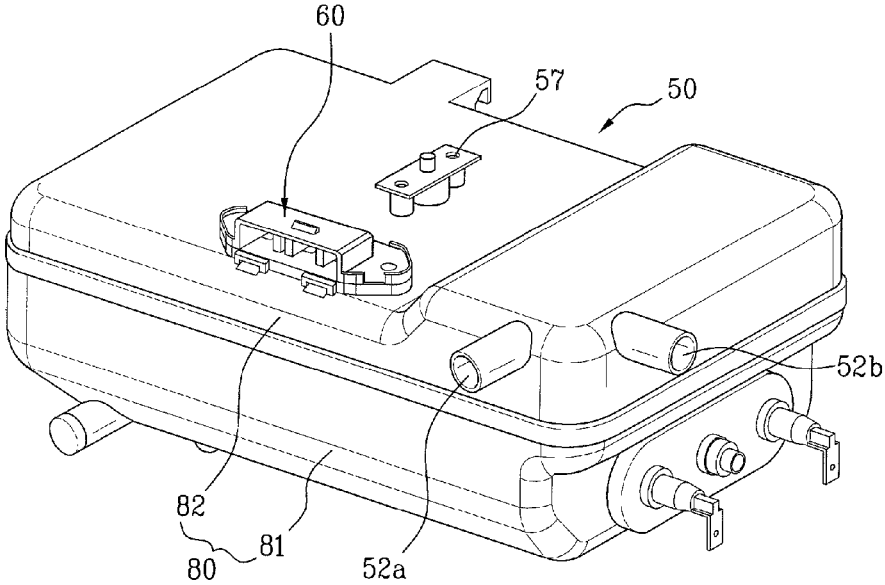

[Fig. 3]
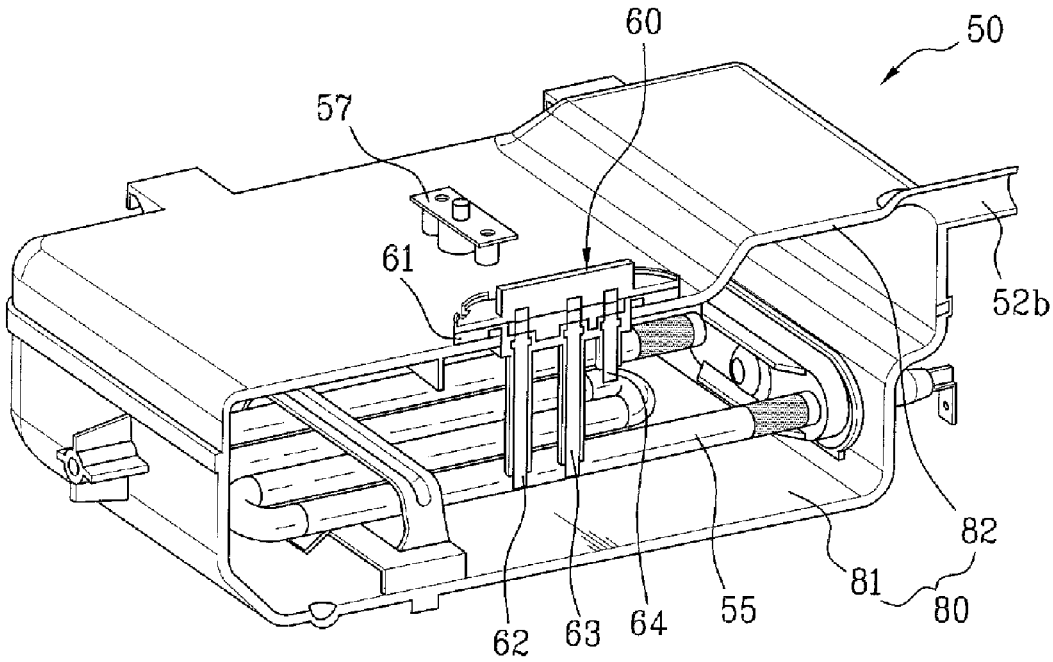
[Fig. 4]
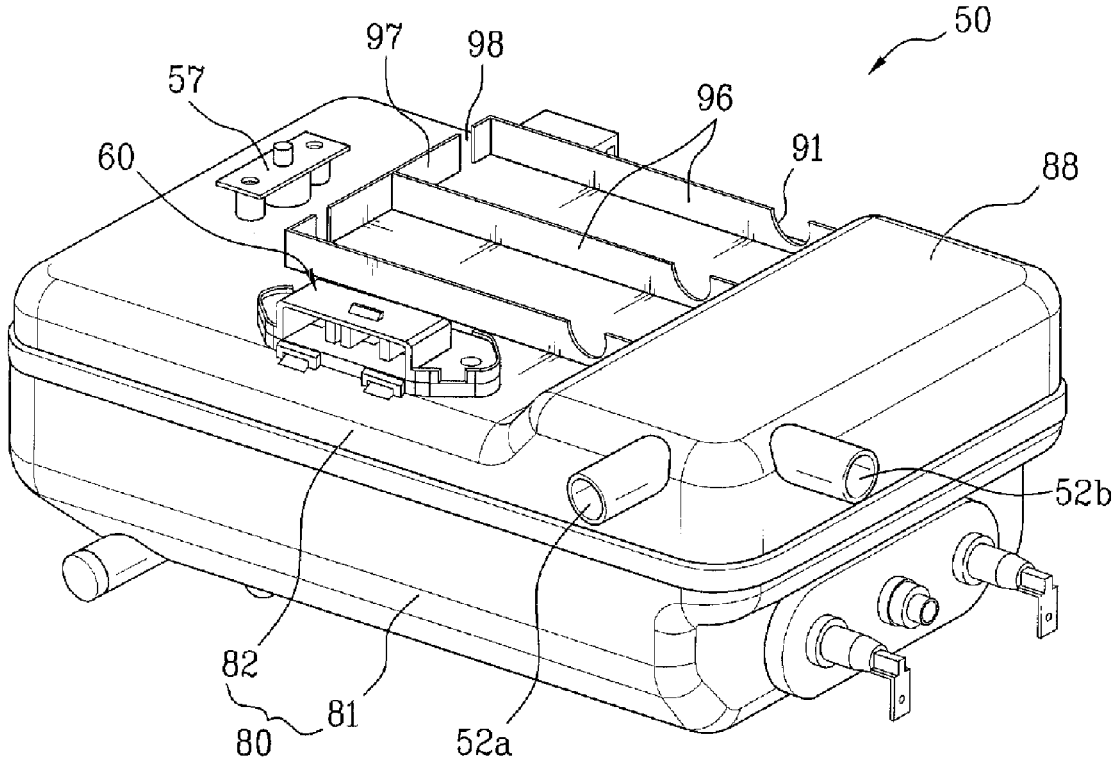

[Fig. 5]
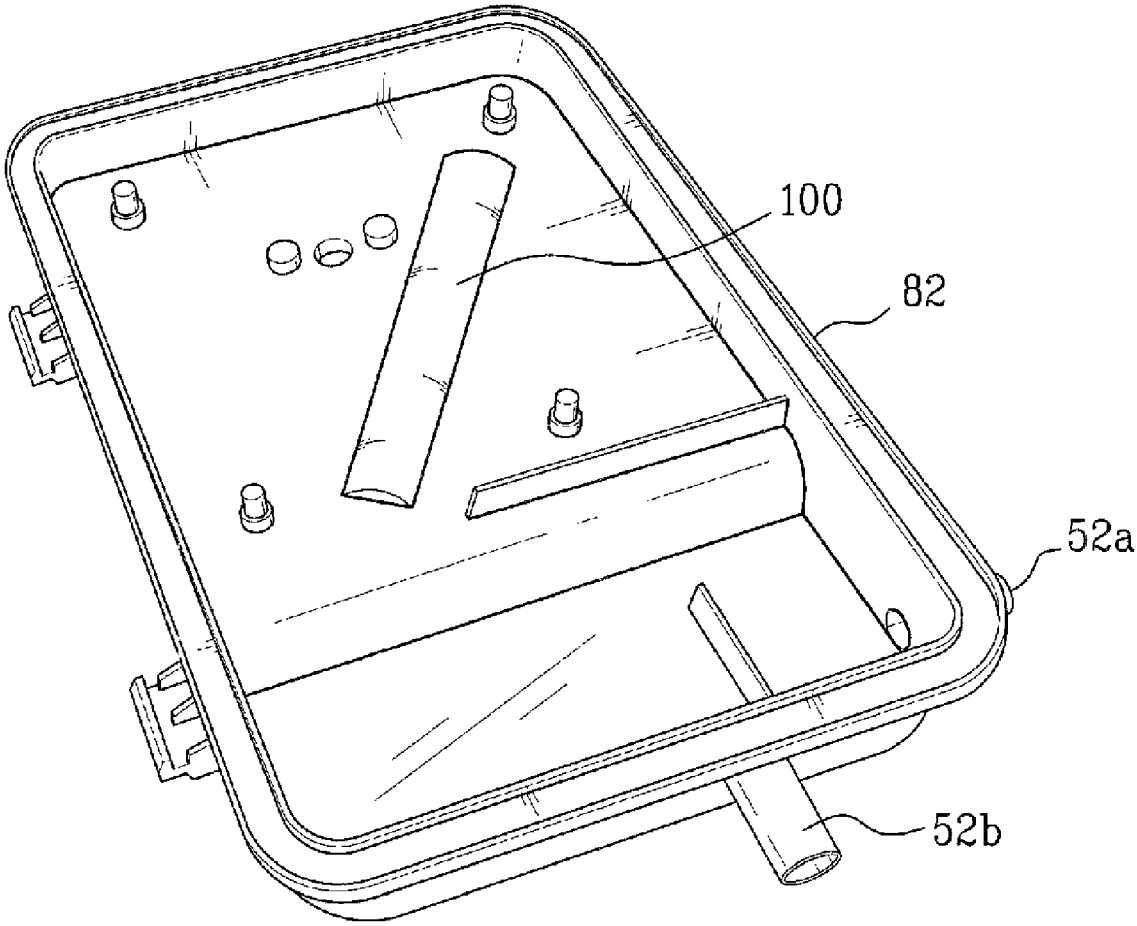

STEAM GENERATOR OF DRUM WASHING MACHINE

This application claims priority to International application No. PCT/KR2006/001901 filed on May 21, 2006, Korean Application No. 20-2005-0014479 filed on May 23, 2005, Korean Application No. 10-2005-0081230 filed on Sep. 1, 2005, all of which are incorporated by reference, as if fully set forth herein.

TECHNICAL FIELD

The present invention relates to a drum washing machine, and more particularly, to a steam generator of a drum washing machine which can prevent deformation of a housing in an injection molding process, so as to improve efficiency on connection of the housing.

BACKGROUND ART

In general, a washing machine is largely classified into a pulsator type washing machine, and a drum type washing machine. The pulsator type washing machine washes laundry using a frictional force generated between water current and the laundry by rotating a pulsator, and the drum type washing machine washes the laundry using a drop of the laundry as well as the frictional force.

In recent days, it is thus seen that there has been provided a drum type washing machine using the steam.

FIG. 1 is a perspective view of schematically illustrating a related art drum type washing machine.

Referring to FIG. 1, a related art drum type washing machine includes a cabinet 10 defining the exterior thereof; a cylindrical tub 20 vertically suspended within the cabinet 10 for holding washing water; a drum 30 rotatably mounted within the tub 20; a driving motor (not shown) for driving the drum 30; and a steam generator 50 for supplying the steam to the inside of the drum 30.

In front of the cabinet 10, a laundry introduction opening 13 for loading and unloading the laundry is provided in communication with the inside of the drum 30. Also, a door 11 is provided for opening and shutting of the laundry introduction opening 13. That is, the door 11 turns on its hinge toward the front side of the drum washing machine.

Also, a water supplying valve 15 and a water supplying hose 25 are provided at one side of the drum washing machine, and are connected with an external water pipe (not shown) so as to supply the washing water to the tub 20.

The steam generator 50 is connected with the water supplying hose 25. As the washing water is supplied to the steam generator 50, the steam generator 50 heats the washing water, and then supplies the heated washing water to the drum 30.

Also, a steam supplying pipe 53 is provided at one side of the steam generator 50, whereby the steam supplying pipe 53 serves as a passage for guiding and injecting the steam generated in the steam generator 50 to the inside of the drum 30.

Preferably, one end of the steam supplying pipe 53 is provided with a nozzle for the smooth injection of the steam to the inside of the drum 30. Preferably, the end of the steam supplying pipe 53 for discharging the steam is exposed to the inside of the drum 30.

To prevent the steam injected to the inside of the drum 30 from being in direct contact with the laundry, the end of the steam supplying pipe 53 is provided in communication with an upper portion of the drum 30, preferably.

Referring to FIGS. 2 and 3, the structure of the steam generator 50 will be explained in detail.

As shown in FIG. 2, the steam generator 50 includes a lower housing 81 for defining the exterior thereof as well as the space to hold the washing water; an upper housing 82 connected to an upper surface of the lower housing 81; and a heater 55 for heating the washing water held within the steam generator 50.

Then, an inlet 82*a* is provided at one side of the upper housing 82, wherein the inlet 82*a* for drawing the washing water into the steam generator 50 is connected with the water supplying valve 15. Also, an outlet 82*b* is provided at the other side of the upper housing 82, wherein the outlet 82*b* is connected with the steam supplying pipe 53 for supplying the generated steam to the drum 20.

Referring to FIG. 3, the heater 55 is provided in the lower side of the lower housing 81. As the water is supplied to the steam generator 50, the heater 55 is completely sunk in the water so as to directly heat the water.

Also, a water level sensor 60 and a temperature sensor 57 are provided at one side of the upper housing 82, wherein the water level sensor 60 senses a water level held in the upper housing 82, and the temperature sensor 57 senses the temperature of water as well as steam heated by the heater 55.

The temperature sensor 57 senses the temperature of steam generated in the steam generator 50. Then, if the sensed temperature is higher than a preset value, the temperature sensor shuts off power of the heater 55, to thereby prevent the overheating of the heater 55.

The water level sensor 60 senses the water level held within the steam generator 50 for maintaining the appropriate amount of the water held in the steam generator 50.

That is, if the water level held within the steam generator 50 is lower than a preset value, the water supplying valve 15 is opened for filling up the water. Meanwhile, if the water level held within the steam generator 50 is higher than the preset value, the water supplying valve 15 is closed to stop supplying the water, and the heater 55 is operated to generate the steam.

The water level sensor 60 is provided with a receptacle housing 61; and electrodes 62, 63, and 64. The receptacle housing 61 defines the exterior of the water level sensor 60, and also fixes the water level sensor 60 to the steam generator 50. Each of the electrodes 62, 63, and 64 is provided in a lower portion of the receptacle housing 61 for sensing the water level within the steam generator 50.

Each of the electrodes 62, 63, and 64 is provided at a predetermined length suitable for sensing the water level held within the steam generator 50.

In the meantime, non-explained reference numbers 52*a* and 52*b* correspond to a portion for connecting the water supplying hose 25 with the steam supplying pipe 53.

DISCLOSURE OF INVENTION

Technical Problem

However, the related art steam generator of the drum washing machine has the following problems.

In case of the related art steam generator, when forming the housing for defining the exterior of the steam generator by the injection molding process, the housing is separated from an injection molding frame, and then the housing becomes hardened.

That is, the housing may have the deformation. Especially, the upper housing may have the deformation on its upper surface except a steam-filling part.

Also, the lower housing may have the deformation. Accordingly, if the lower and upper housings have the deformation, it is difficult to smoothly and concisely connect the lower and upper housings to each other, thereby lowering the efficiency on assembling of the steam generator. Also, a small opening may generated between the lower housing and the upper housing due to the inferior connection of the housing. Thus, after mounting the steam generator to the drum washing machine, the steam may leak out in the opening generated between the lower and upper housings.

An object of the present invention is to provide a steam generator of a drum washing machine which can prevent the deformation of housing.

Technical Solution

To achieve these objects and other advantages and in accordance with the purpose of the invention, as embodied and broadly described herein, a steam generator of a drum washing machine comprises a housing which defines the exterior of the steam generator, and holds washing water therein; and at least one deformation-preventing rib provided in the housing so as to prevent the housing from being deformed in an injection molding process.

At this time, the at least one deformation-preventing rib is provided on an outer surface of the housing in a longitudinal direction of the housing.

At least one deformation-preventing rib is provided on an outer surface of the housing in perpendicular to the longitudinal direction of the housing.

At least one deformation-preventing rib is provided on an inner surface of the housing in a longitudinal direction of the housing.

At least one deformation-preventing rib is provided on an inner surface of the housing in perpendicular to the longitudinal direction of the housing.

At least one deformation-preventing rib is provided on an outer surface of the housing in an oblique direction of the housing.

At least one deformation-preventing rib is provided on an inner surface of the housing in an oblique direction of the housing.

At least one deformation-preventing rib is provided with holes for discharging the washing water collected.

Further, a fixation part is provided in an outer side of the housing, for stable fixation of a hose or cable.

Also, the fixation part for fixation of the hose or cable is provided in the deformation-preventing rib.

Advantageous Effects

In the steam generator of the drum washing machine according to the present invention, the deformation-preventing rib may be formed on the upper surface of the upper housing, or the deformation-preventing reinforcing part may be formed on the inner surface of the upper housing, to thereby prevent the upper housing from being deformed in the injection molding process.

BRIEF DESCRIPTION OF THE DRAWINGS

The accompanying drawings, which are included to provide a further understanding of the invention, illustrate embodiments of the invention and together with the description serve to explain the principle of the invention.

In the drawings:

FIG. 1 is a perspective view of schematically illustrating a structure of a drum washing machine according to the related art.

FIG. 2 is a perspective view of illustrating a steam generator of a drum washing machine according to the related art.

FIG. 3 is a perspective view of illustrating an inner structure of a steam generator shown in FIG. 2.

FIG. 4 is a perspective view of illustrating an outer structure of a steam generator including a deformation-preventing rib according to the first embodiment of the present invention.

FIG. 5 is a perspective of illustrating an outer structure of a steam generator including a deformation-preventing rib according to the second embodiment of the present invention.

BEST MODE FOR CARRYING OUT THE INVENTION

Reference will now be made in detail to the preferred embodiments of the present invention, examples of which are illustrated in the accompanying drawings. Wherever possible, the same reference numbers will be used throughout the drawings to refer to the same or like parts.

Except a deformation-preventing rib and a deformation-preventing reinforcing part, a steam generator of the present invention is similar in structure to that of the related art.

FIG. 4 is a perspective view of illustrating an outer structure of a steam generator including a deformation-preventing rib according to the first embodiment of the present invention.

Referring to FIG. 4, a steam generator 50 of a drum washing machine according to the present invention includes a housing 80 comprised of lower and upper housings 81 and 82 connected to each other; a water level sensor 60 provided in the upper housing 82; deformation-preventing ribs 96 and 97 provided on an upper surface of the upper housing 82; and a temperature sensor 57 provided in the housing 80 so as to sense a temperature of washing water.

In addition, a steam-filling part 88 of a protruding structure is provided at one side of the upper housing 82, whereby the steam-filling part 88 is filled with generated steam.

Although not shown, a heater (not shown) for heating water is provided inside the housing 80.

At least one deformation-preventing rib of a predetermined height is formed in a longitudinal direction of the housing 80.

In this case, as shown in FIG. 4, the deformation-preventing ribs may include the deformation-preventing rib 96 formed in the longitudinal direction of the upper housing 82, and the deformation-preventing rib 97 formed in perpendicular to the longitudinal direction of the upper housing 82.

FIG. 4 shows only one rib 97 formed in perpendicular to the longitudinal direction of the upper housing 82. However, it is possible to provide the plurality of ribs formed in perpendicular to the longitudinal direction of the upper housing 82.

At least one hole 98 for discharging the water collected in the upper surface of the housing 80 on performing a washing stroke may be provided to any one or both of the deformation-preventing ribs 96 and 97, preferably.

If the water is collected in the upper surface of the housing 80 for defining the exterior of the steam generator, the, temperature sensor 57 and the water level sensor 60 may have breakdown and misoperation. To prevent the breakdown and misoperation of the temperature sensor 57 and the water level sensor 60, it is necessary to provide the hole 98 in the deformation-preventing rib.

Also, a fixation part 91 is provided in the outer side of the housing 80, preferably, in the deformation-preventing rib, wherein the fixation part 91 fixes the hose or cable provided in the washing machine, to thereby prevent the interference of internal components and maximize the space utilization.

In FIG. 4, the fixation part 91 is provided in the deformation-preventing rib 96 which is formed in the longitudinal direction of the housing 80. However, the fixation part 91 may be provided in the deformation-preventing rib 97 which is formed in perpendicular to the longitudinal direction of the housing 80.

In the drawings, non-explained reference numbers 52*a* and 52*b* correspond to a portion for connecting the water supplying hose 25 with the steam supplying pipe 53.

Although not shown, the deformation-preventing ribs 96 and 97 may be provided on the inner surface as well as the outer surface of the housing 80 in the longitudinal direction of the housing 80 or in perpendicular to the longitudinal direction of the housing 80. The deformation-preventing ribs may be provided on the inner surface as well as the outer surface of the housing 80 in an oblique direction of the housing 80 or in perpendicular to the oblique direction of the housing 80.

On formation of the upper housing 82 including the steam-filling part 88 of the protruding structure, the upper housing 82 may have the deformation during the injection molding process due to the structural characteristics of the steam-filling part 88. In this respect, the deformation-preventing ribs are formed in the predetermined portion of the upper housing 82 having no steam-filling part 88, preferably, to thereby prevent the deformation of upper housing 82.

A function of the steam generator according to the preferred embodiment of the present invention will be explained as follows.

As the washing water is supplied to the inside of the steam generator 50 by the water supplying hose (25 of FIG. 1), the heater 55 is driven so as to heat the washing water. As a result, the steam is generated and the generated steam is guided to the inside of the drum 30 by the steam supplying pipe 53. Then, the washing stroke is performed.

According as the electrodes (62, 63 and 64 of FIG. 3) of the water level sensor 60 are completely sunk in the washing water held in the steam generator 50 and the electric current is applied thereto, the water level sensor 60 senses the water level.

The deformation-preventing ribs 96 and 97 are provided in the housing 80 of the steam generator 50, so that it is possible to prevent the housing 80 from being deformed in the injection molding process.

Accordingly, the lower housing 81 and the upper housing 82 are fabricated within the predetermined dimension without aberration. That is, the lower housing 81 is easily and correctly connected with the upper housing 82. Also, it is possible to prevent an opening from being generated between the lower housing 81 and the upper housing 82 after connecting the lower and upper housings 81 and 82 to each other.

FIG. 5 is a perspective of illustrating an outer structure of a steam generator including a deformation-preventing rib according to the second embodiment of the present invention.

As shown in FIG. 5, a deformation-preventing rib 100 of a semi-cylindrical shape is provided on an inner surface of a housing 82 for defining the exterior of the steam generator, wherein the deformation-preventing rib 100 is formed in an oblique direction of the housing 82.

Like the steam generator according to the first embodiment of the present invention, the steam generator according to the second embodiment of the present invention which includes the deformation-preventing rib 100 of the semi-cylindrical shape can prevent the exterior of the housing from being deformed on the injection molding process. Thus, it is possible to improve the efficiency on connection of the lower and upper housings 81 and 82.

Further, it is possible to prevent an opening from being generated between the lower and upper housings. That is, it is possible to prevent the generated steam from leaking out in the opening between the lower and upper housings.

Also, a hose or a cable is stably fixed in a fixation part of the deformation-preventing rib, thereby preventing the interference of internal components, and improving the space utilization of the drum washing.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

Industrial Applicability

In the steam generator of the drum washing machine according to the present invention, the deformation-preventing rib may be formed on the upper surface of the upper housing, or the deformation-preventing reinforcing part may be formed on the inner surface of the upper housing, to thereby prevent the upper housing from being deformed in the injection molding process.

The invention claimed is:

1. A steam generator of a drum washing machine comprising:

a housing which defines the exterior of the steam generator, and holds washing water therein;

deformation-preventing ribs provided on an outer and upper surface of the housing so as to prevent the housing from being deformed in an injection molding process, wherein the deformation-preventing ribs are provided with a hole for discharging water collected therein and includes a deformation-preventing rib formed in a longitudinal direction of the housing and a deformation-preventing rib formed in a perpendicular direction of the housing; and a fixation part provided in the outer and upper surface of the housing to fix a hose or cable provided in the washing machine.

2. The steam generator of claim 1, wherein the hole is provided to any one or both of the longitudinal deformation-preventing rib and the perpendicular deformation-preventing rib.

3. The steam generator of claim 1, wherein the fixation part provided in the longitudinal deformation-preventing rib.

4. The steam generator of claim 1, wherein a number of the longitudinal deformation-preventing rib is 3 and each of the longitudinal deformation-preventing rib has a fixation part provided in the outer and upper surface of the housing to fix a hose or cable provided in the washing machine.

5. The steam generator of claim 4, wherein the each of the deformation-preventing rib is parallel.

6. The steam generator of claim 5, wherein the fixation part is provided to fix the hose or cable in the perpendicular direction of the housing.

7. The steam generator of claim 1, further comprising a steam-filling part of a protruding structure provided at one side of the upper housing to be filled with generated steam.

8. The steam generator of claim 7, wherein the deformation-preventing ribs are formed in a predetermined portion of the upper housing having no steam-filling part.

9. The steam generator of claim 1, further comprising a semi-cylindrical shaped deformation-preventing rib provided on an inner surface of the upper housing.

10. The steam generator of claim 9, wherein the semi-cylindrical shaped deformation-preventing rib is formed in an oblique direction of the housing.

11. A washing machine comprising:

a cabinet;

a cylindrical tub within the cabinet;

a drum rotatably mounted within the tub; and a steam generator to generate and supply steam to the drum, wherein the steam generator including:

a housing which defines the exterior of the steam generator, and holds washing water therein; and at least one deformation-preventing rib provided on an outer surface of the housing so as to prevent the housing from being deformed in an injection molding process, wherein the at least one deformation-preventing rib is provided with holes for discharging water collected therein, wherein the steam generator further comprises a fixation part provided in the outer and upper surface of the housing to fix a hose or cable provided in the washing machine.

12. The washing machine of claim 11, wherein the at least one deformation-preventing rib includes a deformation-preventing rib formed in a longitudinal direction of the housing and a deformation-preventing rib formed in a perpendicular direction of the housing.

13. The steam generator of claim 12, wherein the holes are provided to any one or both of the longitudinal deformation-preventing rib and the perpendicular deformation-preventing rib.

14. The steam generator of claim 12, wherein the fixation part provided in the longitudinal deformation-preventing rib.

* * * * *